US009533193B2

(12) United States Patent
Silva

(10) Patent No.: US 9,533,193 B2
(45) Date of Patent: Jan. 3, 2017

(54) FOOT-PROPELLED CATAMARAN WATERCRAFT

(71) Applicant: Antonio Dominguez Silva, Mapleton, UT (US)

(72) Inventor: Antonio Dominguez Silva, Mapleton, UT (US)

( * ) Notice: Subject to any disclaimer, the term of this patent is extended or adjusted under 35 U.S.C. 154(b) by 0 days.

(21) Appl. No.: 14/640,019

(22) Filed: Mar. 5, 2015

(65) Prior Publication Data

US 2015/0251729 A1 Sep. 10, 2015

Related U.S. Application Data

(60) Provisional application No. 61/949,178, filed on Mar. 6, 2014.

(51) Int. Cl.

| | |
|---|---|
| ***B63H 16/00*** | (2006.01) |
| ***A63B 31/11*** | (2006.01) |
| ***B63B 35/73*** | (2006.01) |
| *A63B 35/00* | (2006.01) |
| *B63H 16/08* | (2006.01) |

(52) U.S. Cl.

CPC ..... *A63B 31/11* (2013.01); *B63B 35/73* (2013.01); *B63H 16/00* (2013.01); *A63B 35/00* (2013.01); *B63H 16/08* (2013.01)

(58) Field of Classification Search

CPC ..... A63B 35/00; A63B 31/11; B63H 16/00; B63H 1/32; B63H 11/09; B63H 16/08

USPC ..... 114/163, 36.26, 36.27, 39.28,114/61.1–61.25; 440/22

See application file for complete search history.

(56) References Cited

U.S. PATENT DOCUMENTS

| | | | | |
|---|---|---|---|---|
| 1,248,013 | A | 11/1917 | Risso | |
| 3,031,692 | A | 5/1962 | Riek | |
| 3,877,409 | A | 4/1975 | Krogseng | |
| 3,936,897 | A | 2/1976 | Schaumann | |
| 4,034,430 | A | 7/1977 | Joyce | |
| 4,037,280 | A | 7/1977 | Klepsch | |
| 4,543,898 | A * | 10/1985 | Castilla | B63B 1/121 114/163 |
| 4,698,039 | A | 10/1987 | Watson | |
| 4,738,212 | A * | 4/1988 | Schweitzer | B63B 35/73 114/313 |
| 5,080,621 | A | 1/1992 | Nayes | |
| 5,385,497 | A * | 1/1995 | Chu | A63B 35/00 114/352 |
| 5,558,553 | A | 9/1996 | Okano | |
| 5,607,331 | A | 3/1997 | Lekhtman | |
| 5,697,822 | A | 12/1997 | Souter | |
| 6,386,130 | B1 * | 5/2002 | Kuehne | B63B 1/121 114/124 |
| 2008/0314308 | A1 * | 12/2008 | London | B63B 1/121 114/354 |

* cited by examiner

*Primary Examiner* — Andrew Polay
(74) *Attorney, Agent, or Firm* — Angus C. Fox, III

(57) ABSTRACT

This invention provides a foot-propelled catamaran watercraft having a pair of parallel, spaced-apart pontoons rigidly coupled together, an overhead support structure, coupled to the pontoons, from which a rider, wearing a harness, is suspendable, a rider stabilization structure consisting of a pair of mirror-image-operable tillers graspable by the rider, and a rudder mounted at the rear of each of the pontoons coupled to the tillers for steering the watercraft. The watercraft is propelled by rearward thrusting movements of the rider's feet, which are preferably equipped with fins, or flippers.

18 Claims, 2 Drawing Sheets

FOOT-PROPELLED CATAMARAN WATERCRAFT

BACKGROUND OF THE INVENTION

1. Field of the Invention

This invention relates, generally, to aquatic recreational or sports equipment for movement over water surfaces and, more particularly, to a water walking device having a pair of spaced-apart hulls which are propelled by human muscle power.

2. History of the Prior Art

Ever since Jesus of Nazareth and his disciple, Peter, walked on the surface of the Sea of Galilee some two thousand years ago, inventors have been attempting to emulate that feat in less miraculous ways. Dozens of U.S. patents were issued during the twentieth century. A number of those will be briefly described below.

U.S. Pat. No. 1,248,013 to Luigi Risso discloses an APPARATUS FOR WALKING ON THE WATER, essentially consisting of two floats of prismatic shape arranged parallel to each other, in combination with a propeller which can be put in motion by the action of the rider's feet.

U.S. Pat. No. 3,031,692 to Monroe C. Riek, discloses a BOAT, which features two parallel, spaced-apart pontoons interconnected by a platform on which a rider is seated. The boat is propelled by a foot-actuated paddle wheel that is operated by the rider.

U.S. Pat. No. 3,877,409 to Helge Krogseng discloses a pair of side-by-side, user-propelled buoyant WATER SKIS having rear paddle wheels and a mechanism interconnecting the skis and drivingly coupled to the paddle wheels so as to rotate the paddle wheels responsive to relative longitudinal movements of the skis, whereby a user can propel the skis through the water by walking movements.

U.S. Pat. No. 3,936,897 to Peter H. Schaumann discloses a BUOYANT WATER-WALKING APPARATUS including a pair of elongated, buoyant, water-walker assemblies adapted for attachment to the feet of a user for the purpose of supporting the weight of the user and enabling him to propel himself over the water. Each of the assemblies comprises a rigid, elongated base member and at least one buoyant flotation member carried by the base member.

U.S. Pat. No. 4,034,430 to Albert W. Joyce discloses a WATER-WALKING APPARATUS that includes a pair of buoyant parallel pontoons adapted to support a person afloat in the water and balancing means for the person. The pontoons are pivotably interconnected by transverse stabilizers consisting essentially of a pair of elongated slotted members. Bolts or studs are provided on the pontoons dimensioned to permit them to slide within the slots of each member. A transversely extending paddle element is mounted at the bottom of the pontoons and is pivotable substantially 90 degrees from a substantially vertical position to a rearward substantially horizontal position.

U.S. Pat. No. 4,037,280 to Christian Klepsch discloses an APPARATUS FOR WALKING ON WATER OR LAND, which includes a pair of "water shoes" or members of bilaterally-symmetrical shape relative to a central, longitudinal plane. Each member includes a substantially vertically-arranged flotation body for buoyancy and a substantially horizontally-arranged flotation body for stabilization. The two flotation bodies of a shoe are connected to each other substantially at a right angle. In addition, each shoe is provided with paddles at least one of which operates as a standing foot when the shoes are used on land. The paddles are hinged to the underside, preferably of the horizontally extending flotation body so that they may flap into a retracted position when the particular shoe is pulled through the water in a forward direction and so that the paddles may increase the effective surface of the shoe when the latter is pushed in a rearward direction.

U.S. Pat. No. 4,530,668 to Henry D. Braun discloses an APPARATUS FOR WALKING UPON WATER, which includes a flotation device to be worn on each foot of a user. The device comprises a series of horizontally elongated parallel keels having flaps which are pivotably suspended from the keels. When downward force is applied to a floating device, the flaps pivot upwardly to form roofs of channels between adjacent keels. When the device is lifted from the water, the flaps swing downwardly, thereby breaking any suction effect which would cause retention of water within the channel. Such mode of operation improves the ease with which each device can be lifted from the water in walking or skating motion.

U.S. Pat. No. 4,698,039 to Benjamin H. Watson discloses an APPARATUS FOR WALKING ON WATER OR LAND, which comprises a pair of floats, each having a propulsion apparatus attached to its bottom. there is a foot well in each float, which extends from top to bottom, and which is fitted with toe retaining and heel support elements. The propulsion apparatus comprises an I-beam having a top flange, web and bottom flange and pairs of flaps hinged to the web, one of each pair on each side of the web. the pairs are spaced equidistant from each other along the web. The hinge axes are vertical. Each flap hinges between the closed position (against the web) to the open position (about 90 degrees to the web). The longitudinal axis of the float to which it is attached and the web functions as a keel. The bottom flange is angled slightly upward toward the front end. The midpoints of the lengths of the foot wells and propulsion apparatus are somewhat aft of the lengthwise midpoints of the floats. The propulsion apparatus is about half as long as the float.

U.S. Pat. No. 5,080,621 to Alan W. Nayes discloses a WATER WALKING DEVICE having a pair of buoyant hulls, which are longer than they are wide. The hulls have a number of propulsion flaps mounted on the bottom thereof. The flaps are hinged and fold into the hull, thereby creating cup-like resistance chambers when hinged open to offset the rearward force of the wearer. The flaps rotate inwardly when the hull is urged forward, thereby allowing the wearer to be propelled forward by a walking action. A footwell is located in each huoll with the bottom below the waterline and near the center of gravity. A resilient shoe attached into the footwell provides a removable connection between the wearer and the device. A propulsion fin under the footwell provides stability. A pair of optional side panels function in the same manner as the flaps, thereby improving propulsion.

U.S. Pat. No. 5,558,553 to Kiyoshige Okano discloses a WATER WALKING DEVICE, HULL AND STOCK THEREOF. The device consists of a pair of hulls having footwells and a pair of stocks. A water surface blade at the rear of the hull is formed in a concave shape pointing towards the front of the hull. The underwater blade at the rear of the vertical stabilizer fin is formed in a fan shape towards the rear of the vertical stabilizer fin, and the rear surface of said underwater blade is formed in a concave shape pointing to the forward part of the vertical stabilizer fin. The blade sections on the stock consist of the blade body formed in a rim shape, and vanes formed on the lower part of this blade body. A plurality of these vanes form a radial pattern at fixed intervals, centering around the shaft of the stock.

U.S. Pat. No. 5,607,331 to David Lekhtman discloses a WATER WALKING APPARATUS comprising a float member having a top surface, a bottom surface, a front end and a rear end. A pair of elongated chambers extend in the float member between the top and bottom surfaces. Each elongated chamber has respective openings on the top and bottom surfaces and at the rear end. Flap valves are provided for permitting water to enter through the bottom openings of the elongated chambers and foot pumps are provided for ejecting water through the rear ends of the chambers.

U.S. Pat. No. 5,697,822 to Kelly K. Souter discloses an APPARATUS FOR WALKING UPON WATER, which includes a pair of buoyant platforms with a pair of sidewalls attached to the top surface of each buoyant platform. Removable, inflatable buoyant pontoons are secured to the buoyant platforms through flexible sleeves secured to the sidewalls. The pontoons provide adjustable degrees of buoyancy to allow the user to walk on water. The pontoons have footwells into which the user inserts his foot, resting the foot on the buoyant platform. The foot is secured in place by the addition of air pressure to the pontoon. The buoyant platform has paddles mounted on its bottom surface, which rotate rearwardly when the user moves the apparatus forward, thus reducing resistance to forward movement. The paddles rotate forward against a specially structured stop whenever there is any backward or slipping motion of the apparatus, thereby resisting any backward movement of the apparatus.

SUMMARY OF THE INVENTION

The present invention provides a foot-propelled catamaran watercraft having a pair of parallel, spaced-apart pontoons rigidly coupled together, an overhead support structure, coupled to the pontoons, from which a rider, wearing a harness, is suspendable, a rider stabilization structure consisting of a pair of mirror-image-operable tillers graspable by the rider, and a rudder mounted at the rear of each of the pontoons coupled to the tillers for steering the watercraft. The watercraft is propelled by rearward thrusting movements of the rider's feet, which are preferably equipped with swim fins.

DETAILED DESCRIPTION OF THE INVENTION

The foot-propelled catamaran watercraft will now be described with reference to the attached drawing figures. It should be understood that the drawings are not necessarily drawn to scale, and are intended to be merely illustrative of the invention.

Figure 1:
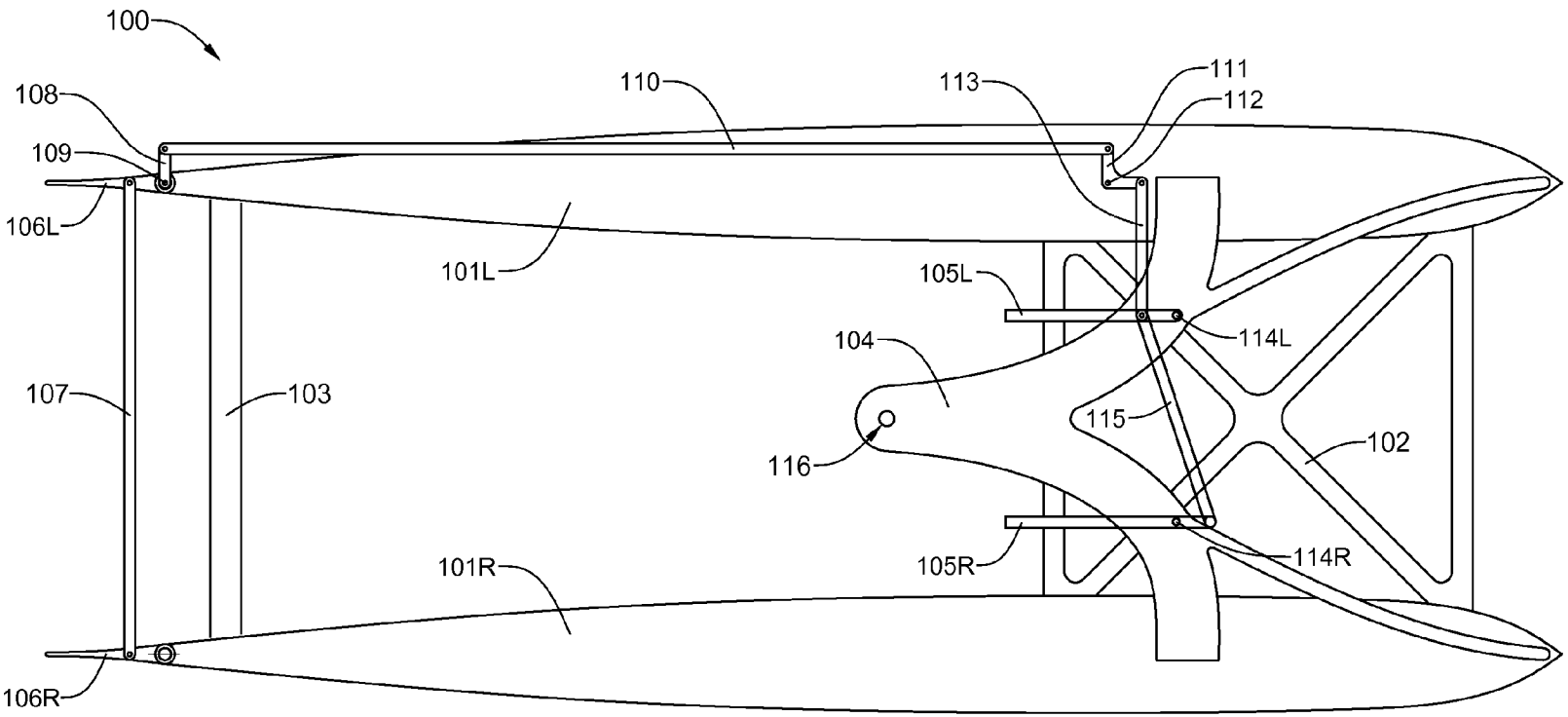
FIG. 1 is a top plan view of the foot-propelled catamaran watercraft.

Referring now to FIG. 1, the foot-propelled catamaran watercraft 100 includes a pair of parallel, spaced-apart pontoons 101L and 101R, which are rigidly coupled together by a front triangulated bracing structure 102 and a rear transverse brace 103, a rigid, triangulated overhead support structure 104, that is coupled to the pontoons 101L and 101R, from which a rider, wearing a harness, is suspendable, a rider stabilization structure consisting of a pair of mirror-image-operable tillers 105L and 105R graspable by the rider, and a rudder 106L hingeably mounted to the rear of pontoon 101L and a rudder 106R hingeably mounted to the rear of pontoon 101R. Because the rider must be free to thrust rearward with his feet, it is important that the steering mechanism of the watercraft not impart a rotational moment to the rider's body. Because steering of the watercraft is accomplished by squeezing together and spreading apart the mirror-image tillers, no moment is generated. The rudders 106L and 106R are intercoupled by a rigid connector tube 107. The left rudder is rigidly coupled to a control arm 108 that is rotatable about the rudder's hinge axis 109. A rigid longitudinal control tube 110 interconnects control arm 108 to a right angle control arm pair 111 that rotates about axis 112 and converts the longitudinal motion of control tube 110 to transverse motion supplied through a rigid transverse control tube 113 ever that is and 106R mounted at the rear of each of the pontoons coupled to the tillers 105L and 105R for steering the watercraft 100. The left tiller 105L rotates about pivot axis 114L, while the right tiller 105R rotates about pivot axis 114R. A first end of coupler bar 115 is coupled to the left tiller 105L aft of pivot axis 114L, while a second end of the coupler bar 115 is coupled to the right tiller 105R fore of the pivot axis 114R. This arrangement ensures that the tilles 105L and 105R will function as mirror images of one another. It will be noted that an aperture 116 is centered in the overhead support structure 104.

Figure 2:
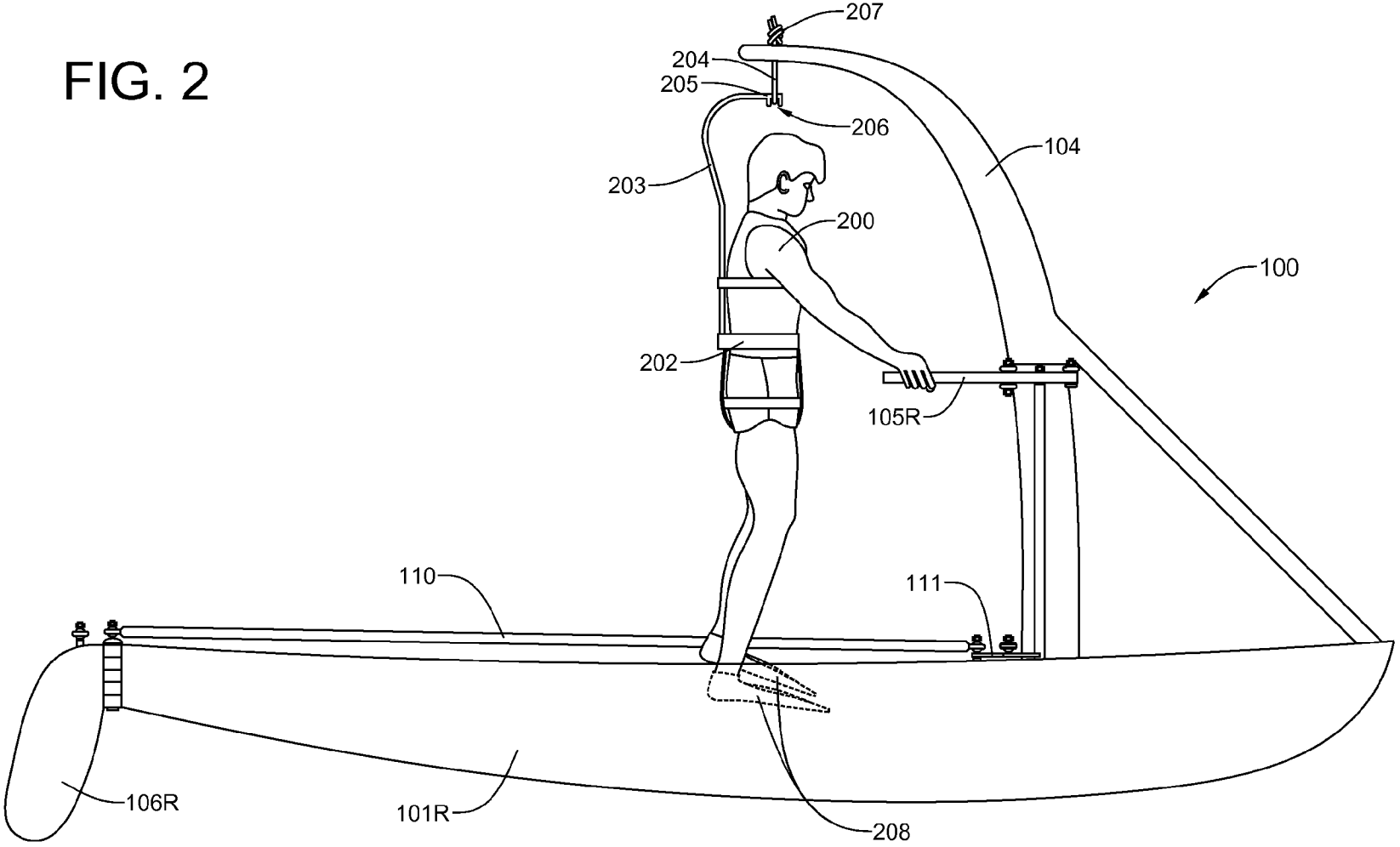
FIG. 2 is a right-side elevational view of the foot-propelled catamaran watercraft having a harnessed rider suspended from an overhead support structure.

Referring now to FIG. 2, a rider 201 is shown wearing a harness 202 having straps that pass between the rider's legs, around the rider's chest, and around the rider's waist. A rigid hanger bracket 203, which is securely attached to the harness 202, is suspended from the overhead support structure 104 with a flexible rope or cord 204. It is advisable that rope or cord 204 be quipped with an auto-release feature so that the rider 201 would not be tied to the watercraft 100 in the event it were to capsize. FIG. 2 shows a very simple auto-release mechanism. An upper end 205 of the hanger bracket 203 is equipped with a notch 206 around which the rope or cord 204 passes, forming a noose. Both ends of the rope or cord 204 pass through the aperture 116 and are tied in a knot 207 in order to anchor the rope or cord 204 to the overhead support structure 104. The watercraft 100 is propelled by rearward thrusting movements of the rider's feet, which are preferably equipped with swim fins 208.

While only a single embodiment of the invention has been illustrated and described, it will be obvious to those having ordinary skill in the art that modifications and changes may be made thereto without departing from the scope of the invention.

What is claimed is:

1. A foot-propelled catamaran watercraft comprising:

a pair of parallel, spaced-apart pontoons rigidly coupled together;

a rigid overhead support structure, coupled to the pontoons, from which a rider is suspendable by means of a harness;

a hanger bracket, which is secured to both the overhead support structure and the harness;

a movable rider stabilization structure graspable by the rider; and a rudder mounted at the rear of each of the pontoons coupled to the rider stabilization structure for steering the watercraft;

wherein the watercraft is propelable by rearward thrusting movements of the rider's feet.

2. The foot-propelled catamaran watercraft of claim 1, which further comprises an auto-release mechanism for releasing the hanger bracket from the overhead support structure.

3. The foot-propelled catamaran watercraft of claim 2, wherein said hanger bracket is equipped with a notch at an upper end thereof.

4. The foot-propelled catamaran watercraft of claim 2, wherein said auto-release mechanism is a noose that wraps around the notch, passes through an aperture in the overhead support structure and is tied in a knot after passing through the aperture, thereby enabling the noose to detach from the notch and release the rider if downward tension on the noose is not maintained.

5. The foot-propelled catamaran watercraft of claim 1, wherein said rider stabilization structure comprises a pair of mirror-image-operable tillers which operate both rudders simultaneously.

6. A foot-propelled catamaran watercraft comprising:

a pair of parallel, spaced-apart pontoons rigidly coupled together;

a rigid overhead support structure, coupled to the pontoons, from which a rider is suspendable by means of a harness;

a rider stabilization structure, which includes spaced-apart right and left tillers, both of which are graspable by the rider, said tillers being mirror-image-operable by alternately spreading them apart or squeezing them together; and a rudder mounted at the rear of each of the pontoons coupled to the tillers for steering the watercraft;

wherein the watercraft is propelable by rearward thrusting movements of the rider's feet.

7. The foot-propelled catamaran watercraft of claim 6, which further comprises a hanger bracket, which is secured to both the overhead support structure and the harness.

8. The foot-propelled catamaran watercraft of claim 7, which further comprises an auto-release mechanism for releasing the hanger bracket from the overhead support structure.

9. The foot-propelled catamaran watercraft of claim 7, wherein said hanger bracket is equipped with a notch at an upper end thereof.

10. The foot-propelled catamaran watercraft of claim 8, wherein said auto-release mechanism is a noose that wraps around the notch, passes through an aperture in the overhead support structure and is tied in a knot after passing through the aperture, thereby enabling the noose to detach from the notch and release the rider if downward tension on the noose is not maintained.

11. The foot-propelled catamaran watercraft of claim 1, wherein the rider's feet are equipped with swim fins.

12. The foot-propelled catamaran watercraft of claim 6, wherein the rider's feet are equipped with swim fins.

13. A foot-propelled catamaran watercraft comprising:

a pair of parallel, spaced-apart pontoons rigidly coupled together;

a rigid overhead support structure, coupled to the pontoons, from which a rider is suspendable by means of a harness;

a rider stabilization structure, graspable by the rider, which includes a pair of spaced-apart tillers that are operated by alternately spreading them apart and squeezing them together; and a rudder mounted at the rear of each of the pontoons coupled to the tillers for steering the watercraft;

wherein the watercraft is propelable by rearward thrusting movements of the rider's feet.

14. The foot-propelled catamaran watercraft of claim 13, which further comprises a hanger bracket, which is secured to both the overhead support structure and the harness.

15. The foot-propelled catamaran watercraft of claim 14, which further comprises an auto-release mechanism for releasing the hanger bracket from the overhead support structure.

16. The foot-propelled catamaran watercraft of claim 14, wherein said hanger bracket is equipped with a notch at an upper end thereof.

17. The foot-propelled catamaran watercraft of claim 15, wherein said auto-release mechanism is a noose that wraps around the notch, passes through an aperture in the overhead support structure and is tied in a knot after passing through the aperture, thereby enabling the noose to detach from the notch and release the rider if downward tension on the noose is not maintained.

18. The foot-propelled catamaran watercraft of claim 13, wherein the rider's feet are equipped with swim fins.

* * * * *